US007151210B2

(12) United States Patent
Janes et al.

(10) Patent No.: US 7,151,210 B2
(45) Date of Patent: Dec. 19, 2006

(54) SOLID BODY ACOUSTIC GUITAR

(75) Inventors: Richard Janes, St. Charles, IL (US); Dan Smith, Corona, CA (US); George Blanda, Corona, CA (US)

(73) Assignee: Fender Musical Instruments Corporation, Scottsdale, AZ (US)

( * ) Notice: Subject to any disclaimer, the term of this patent is extended or adjusted under 35 U.S.C. 154(b) by 380 days.

(21) Appl. No.: 10/256,340

(22) Filed: Sep. 26, 2002

(65) Prior Publication Data

US 2004/0060417 A1 Apr. 1, 2004

(51) Int. Cl.
*G10D 3/00* (2006.01)

(52) U.S. Cl. ..... 84/291

(58) Field of Classification Search ..... 84/267, 84/290, 291
See application file for complete search history.

(56) References Cited

U.S. PATENT DOCUMENTS

| | | | | | |
|---|---|---|---|---|---|
| 4,411,186 | A * | 10/1983 | Faivre | 84/291 |
| 4,741,238 | A * | 5/1988 | Carriveau | 84/291 |
| 5,235,891 | A * | 8/1993 | Klein | 84/291 |
| 5,780,758 | A * | 7/1998 | McGill | 84/296 |
| 5,900,561 | A * | 5/1999 | Wechter | 84/267 |
| 6,538,183 | B1 * | 3/2003 | Verd | 84/291 |
| 6,610,915 | B1 * | 8/2003 | Schleske | 84/291 |
| 6,723,908 | B1 * | 4/2004 | Chapman et al. | 84/291 |

FOREIGN PATENT DOCUMENTS

WO 97/43753 * 11/1997

* cited by examiner

*Primary Examiner*—Kimberly Lockett
(74) *Attorney, Agent, or Firm*—Robert D. Atkins; Quarles & Brady Streich Lang, LLP

(57) ABSTRACT

A guitar body is formed of a generally solid material having a cavity formed therein and substantially lacking a soundboard. A soundboard is formed of a generally planar material attached to the solid material, so as to substantially cover the cavity.

41 Claims, 4 Drawing Sheets

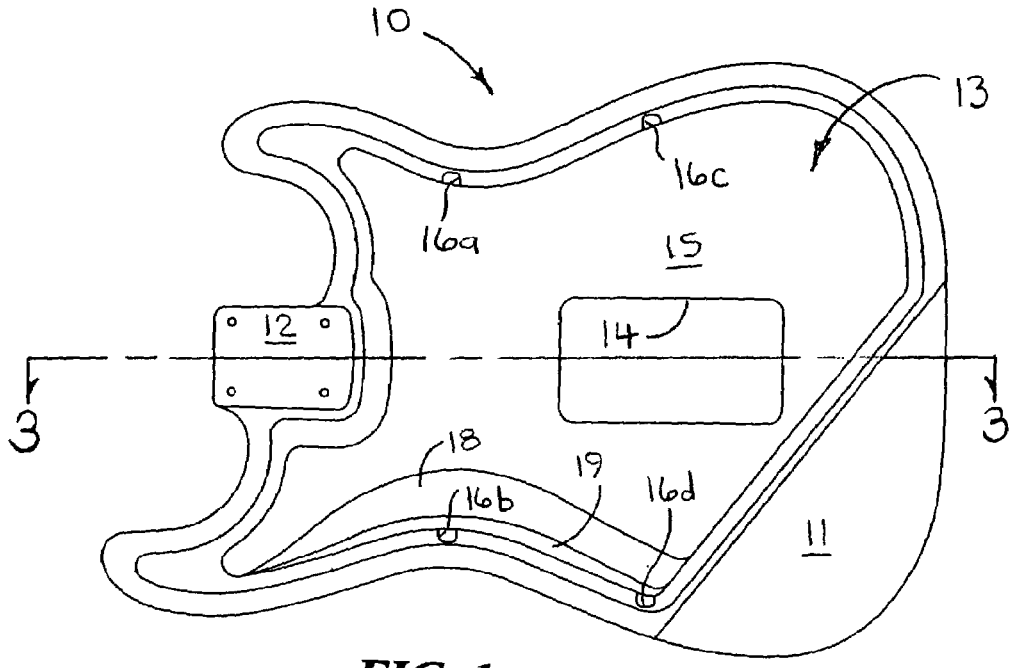
FIG. 1
FIG. 2
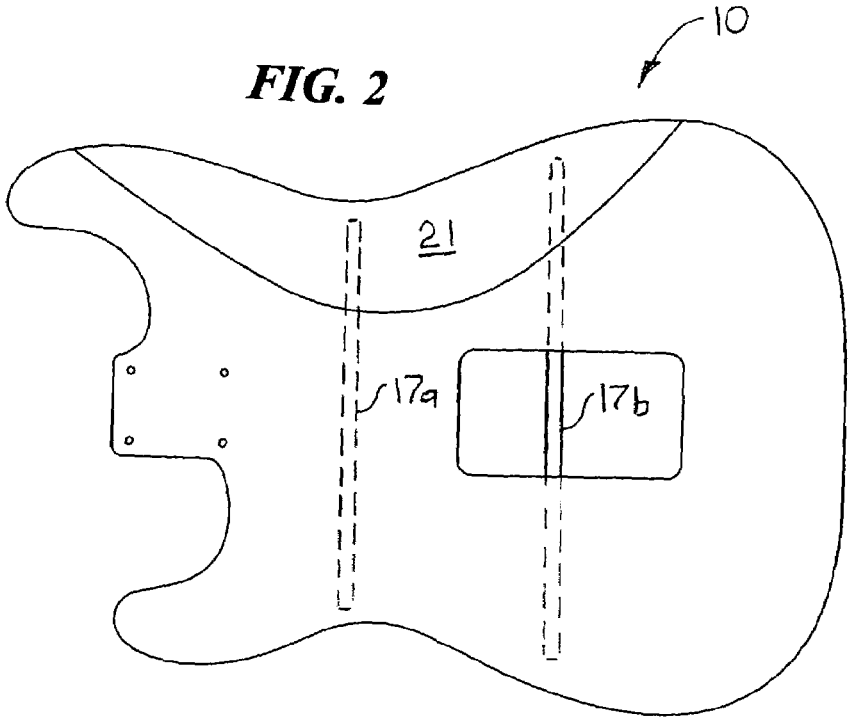

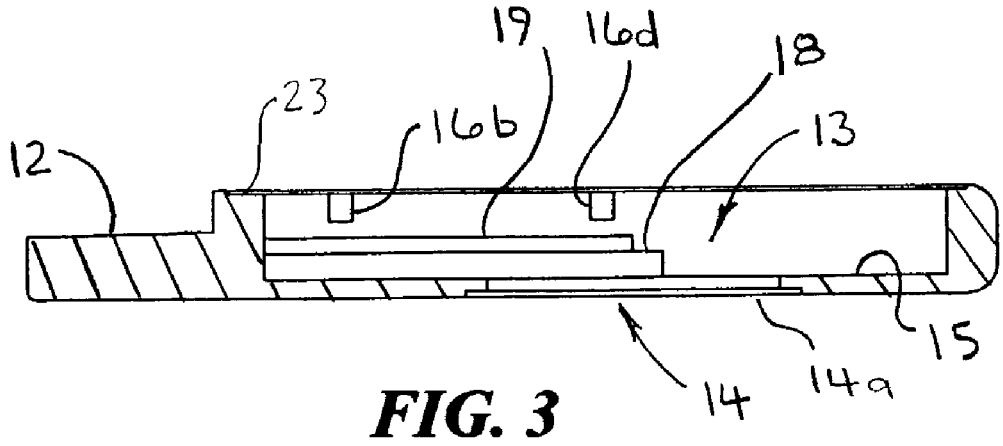
FIG. 3
FIG. 4
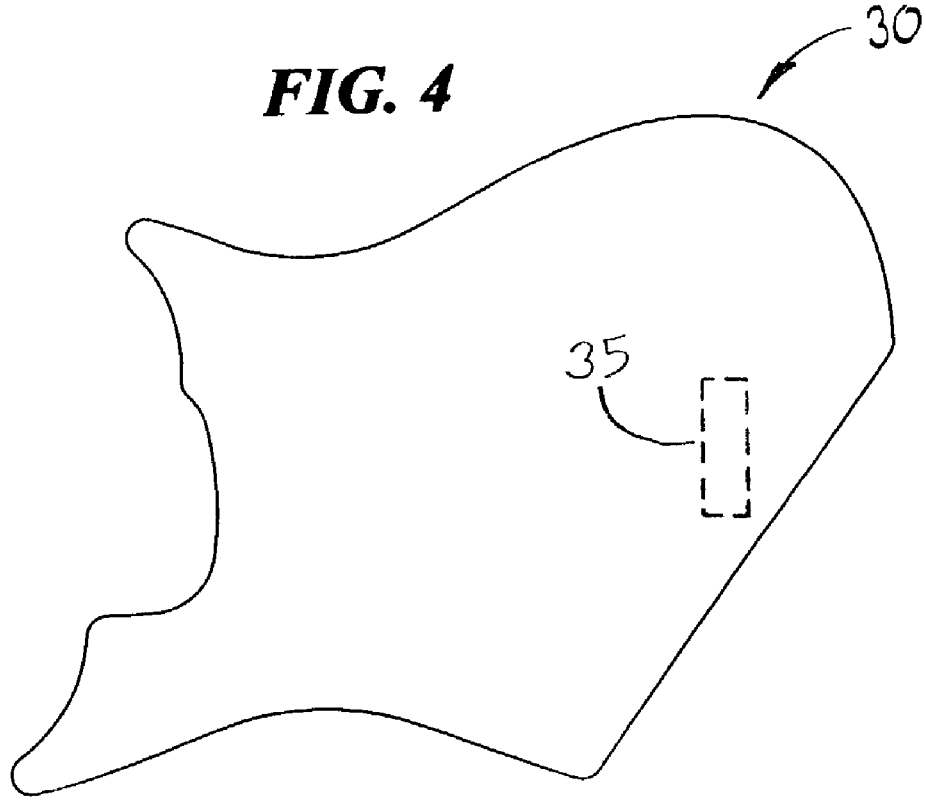

SOLID BODY ACOUSTIC GUITAR

FIELD OF THE INVENTION

The present invention relates generally to stringed musical instruments. The present invention relates more particularly to an acoustic guitar having a solid body and a graphite epoxy composite soundboard which are configured so as to allow the guitar to more closely approximate the performance characteristics of an acoustic guitar while maintaining the comfort of a contoured solid body guitar.

BACKGROUND OF THE INVENTION

Electric guitars are well-known. Electric guitars can be broadly classified into two general types. One type is the solid body electric guitar. Ordinarily, solid body electric guitars must be used with electronic amplification in order to provide satisfactory listening volume. This is because solid body electric guitars lack a resonating chamber and soundboard, both of which are necessary to provide sufficient volume for use without electronic amplification.

The other type of electric guitar is the hollow body electric guitar. Some hollow body electric guitars can be played without electronic amplification and still provide enough volume to be heard, at least in limited applications. Although some hollow body electric guitars can be played without electronic amplification, the volume produced thereby can be less than optimal because the resonating chambers and soundboards of hollow body electric guitars are generally not optimized for acoustic playing.

Typically, solid body electric guitars are substantially less susceptible to feedback than hollow body electric guitars. Indeed, the resistance of solid body electric guitars to feedback provided motivation for the development of solid body electric guitars.

Acoustic guitars, which may lack any electronic amplification whatsoever, are also well-known. Such acoustic guitars generally provide sufficient volume for use in small, acoustically suitable venues. Thus, acoustic guitars are frequently used without electronic amplification. When electronic amplification is desired, a microphone may be used to pick up sound from an acoustic guitar. A public address (PA) amplifier may then be used to electronically amplify the sound from the acoustic guitar to a desired volume.

Acoustic guitars which have been modified, so as to facilitate direct (without the use of a microphone) electronic amplification, are also known. Typically, a piezoelectric or other type of transducer is attached to the bridge or soundboard of an acoustic guitar to facilitate such electronic amplification.

Thus, acoustic guitars and hollow body electric guitars (at least in some instances), are suitable for being played without electronic amplification. It is also desirable to play a solid body guitar without electronic amplification. Some solid body guitars have bevels or contours which allow the guitar to conform somewhat to a person's body. Contoured solid body guitars are typically smaller in size and more comfortable to play than either hollow body electric guitars or acoustic guitars. Further, many guitar players prefer the look and feel of a solid body guitar. However, as mentioned above, contemporary solid body electric guitars are not suitable for such non-amplified use, because without electronic amplification they provide insufficient volume.

In view of the foregoing, it is desirable to provide a solid body acoustic guitar which is adequate for playing without electronic amplification. It is also desirable to provide such a guitar which is suitable for use with electronic amplification and which generally duplicates the feedback resistance of contemporary solid body guitars.

SUMMARY OF THE INVENTION

The present invention specifically addresses and alleviates the above-mentioned deficiencies associated with traditional solid body and amplified acoustic guitars. More particularly, the present invention comprises a guitar body formed of a generally solid material, such as wood, having a cavity formed therein. The generally solid material does not, itself, define a soundboard. A soundboard formed of a generally planar material, such as graphite epoxy composite material, is attached to the generally solid material, so as to substantially cover the cavity. In this manner, a solid body style guitar is provided which has adequate volume for use without electronic amplification.

BRIEF DESCRIPTION OF THE DRAWINGS

FIG. 1 is a front view of a body for a solid body acoustic guitar according to the present invention, wherein the body is styled generally in the fashion of a Fender (a federally registered trademark of Fender Musical Instruments Corporation of Scottsdale, Ariz.) Stratocaster (a federally registered trademark of Fender Musical Instruments Corporation of Scottsdale, Ariz.) guitar;

FIG. 2 is a back view of the guitar body of FIG. 1;

FIG. 3 is a cross-sectional side view of the guitar body of FIG. 1, taken along line 3 thereof;

FIG. 4 is a front view of a soundboard for the guitar body of FIGS. 1–3;

DETAILED DESCRIPTION OF THE INVENTION

Figure 5:
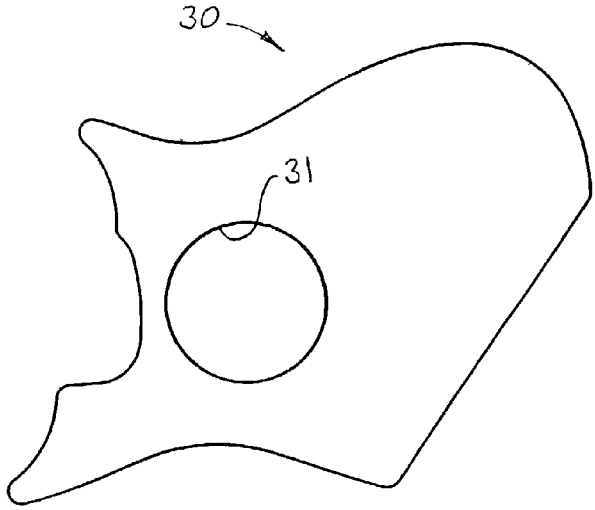
FIG. 5 is a front view of an alternative soundboard for the guitar body of FIGS. 1–3, wherein the soundboard has a circular opening formed therein.

The detailed description set forth below in connection with the appended drawings is intended as a description of the presently preferred embodiment of the invention, and is not intended to represent the only form in which the present invention may be constructed or utilized. The detailed description sets forth the construction and functions of the invention, as well as the sequence of steps for operating the invention in connection with the illustrated embodiment. It is to be understood, however, that the same or equivalent functions may be accomplished by different embodiments that are also intended to be encompassed within the spirit and scope of the invention.

The present invention comprises an acoustic guitar and an electric guitar, both of which are adequate for intimate unamplified or acoustic playing. The present invention preferably utilizes the advantageous and very desirable general body configuration of a Fender Stratocaster guitar. That is, the solid body acoustic guitar of the present invention has a body which is preferably shaped like the body of a Fender Stratocaster guitar and which preferably includes the front and back bevels or contours of a Fender Stratocaster guitar body. As those skilled in the art will appreciate, the front and back bevels of a Fender Stratocaster guitar substantially enhance comfort during playing of the guitar and are thus considered very desirable features thereof.

According to the preferred embodiment of the present invention, the body of the guitar is configured so as to substantially mimic the sound of an acoustic guitar having a contemporary wooden body.

The solid body acoustic guitar of the present invention is illustrated in FIGS. 1 through 8, which depicts a presently preferred embodiment thereof. The presently preferred embodiment depicted in FIGS. 1 through 8 is fashioned in the style of a Fender Stratocaster guitar. However, as those skilled in the art will appreciate, the present invention may alternatively be fashioned in any other desired style.

Referring now to FIGS. 1–3, the body 10 optionally comprises a front bevel 11, formed thereon so as to enhance comfort during playing of the guitar, according to well know principles.

Neck mounting surface 12 facilitates the mounting of a neck 40 (FIG. 8) to the body 10 via the use of fasteners, such as screws or bolts, which preferably pass through the four holes in the neck mounting surface 12 and are preferably received within the neck 40, so as to attach the neck to the body 10, according to well-known principles.

Alternatively, the neck may be mounted to the body 10 via any other desired means. For example, the neck may be adhesively bonded to the body, according to well-know principles.

The body 10 is comprised generally of a solid piece of material. That is, the body 10 is formed generally in the manner of a contemporary solid electric guitar body. By way of contrast, the body 10 is not formed from a plurality of sheets of generally planar material, so as to form a comparatively thin-walled structure in the fashion of a contemporary acoustic guitar.

The generally solid material of the body 10 is formed so as to have a cavity 13 (best seen in the FIG. 3) therein. The cavity 13 is open at the top or upper surface of the guitar, such that no soundboard is defined by the generally solid material of the body 10. The soundboard 30 (FIG. 4) is a separate structure with respect to the body 10 and is attached to the body 10, as discussed in detail below.

According to one embodiment of the present invention, the body is substantially a solid electric guitar body which has been substantially hollowed out (for example, routed or milled) so as to form the cavity 13. The cavity 13 (in combination with the soundboard 30 of FIG. 4) defines a resonating chamber, much in the same fashion that the hollow structure of contemporary acoustic guitar body forms a resonating chamber. The resonating chamber and the soundboard 30 facilitate the production of sound having adequate volume and desired tone to permit acoustic playing of the present invention. The bottom of the cavity 13 is partially defined by floor 15, which likewise defines a substantial portion of the back of the guitar body 10.

The solid guitar body 10 is preferably formed of wood, such as either a single piece of wood or a plurality of pieces of wood that are attached to one another. However, any suitable material or combination of materials may alternatively also be utilized.

Thus, the body 10 may be formed from a single block of wood. However, for aesthetic or structural reasons, it may be preferable to form the body from several pieces of wood which are attached to one another, such as via adhesive bonding. For example, the body 10 may be formed from several pieces of wood which are configured in a manner which mitigates undesirable cupping of the body 10.

Generally, the solid guitar body 10 may be formed using the same processes and materials that are used to form the body of a contemporary solid body electric guitar.

The cavity 13 may be formed in the body 10 via routing, milling or via any other desired process. Optionally, the body 10 may be a molded structure having the cavity 13 formed in the molding process. Optionally, the body 10 may be formed via the laying up of a composite material, wherein the cavity 13 is defined during the laying up process.

Optionally, an opening 14 is formed in the bottom of the cavity 13, so as to facilitate the use, assembly, and maintenance of optional electronics, such as a preamplifier. Thus, the opening 14 allows such optional electronics to be inserted into the cavity 13 of the body 10 after the soundboard 30 has been attached thereto. The opening 14 also facilitates the making of adjustments and repairs to any such items disposed within the cavity 13. As those skilled in the art will appreciate, such electronics are frequently used, even in contemporary acoustic guitars, so as to enhance, modify and/or amplify the sound of the guitar.

Opening 14, if provided, is typically covered with a cover plate (14*a*) which conforms generally in size and shape to the size and shape of the opening 14 and which may be comprised of plastic, graphite composite, metal, or any other desired material. Preferably, the cover plate is formed of the same material as the soundboard. The opening 14 may, optionally, be routed such that the cover plate 14*a* is mounted flush with the back of the guitar, according to well-known principles. The cover plate 14*a* is preferably removably attached to the guitar body 10, such as via screws, bolts, or other fasteners. Alternatively, the cover plate 14*a* may be adhesively bonded or otherwise attached to the body 10.

The use of such a cover plate 14*a* to cover opening 14 enhances the structural strength of the guitar body 10, particularly the back surface of the body 10 defined by the bottom of the cavity 13. Preferably, the cover plate 14*a*, if utilized, is sized, shaped and formed of a material which both enhances the strength of the body 10 and which has desirable acoustic properties.

It is worthwhile to appreciate that, although the solid body acoustic guitar of the present invention is adequate for use without electronic amplification, electronic amplification may optionally be used with the present invention, if desired. Thus, like a contemporary acoustic guitar, the present invention may be utilized either with or without electronic amplification. Indeed, the solid body acoustic guitar of the present invention may optionally additionally comprise any desired combination of electric pickups, volume controls, tone controls, and/or preamplifiers.

If electronic amplification of the solid body acoustic guitar of the present invention is desired, then one or more pickups or other transducers can be mounted on the body 10 according to well known principles. For example, a piezoelectric transducer may be positioned within the bridge, preferably under the saddle, so as to facilitate such electronic amplification.

Support rods and/or braces may optionally be used to enhance the structural strength of the guitar. As discussed in detail below, support rods may optionally be used to enhance the structural strength of the guitar body 10, while braces may optionally be used to enhance the structural strength of the soundboard 30. However, according to the preferred embodiment of the present invention, no braces are used for the soundboard 30.

Optionally, four u-shaped grooves 16*a*–16*d*, are formed in the cavity 13 so as to accommodate the use of two optional transverse support rods 17*a* and 17*b* (shown in dashed lines in FIG. 2). Any desired number of such u-shaped grooves and support rods may be utilized. Thus, transverse support rod 17*a* is received within u-shaped grooves 16*a* and 16*b* and, similarly, transverse support rod 17*b* is received within u-shaped grooves 16*c* and 16*d*. As those skilled in the art will appreciate, the number, location, and materials of such transverse support rods 17*a* and 17*b* will depend upon desired acoustic characteristics of the guitar body 10.

The support rods 17*a* and 17*b* are preferably adhesively bonded within the four u-shaped grooves 16*a*–16*d*, preferably utilizing epoxy.

As those skilled in the art will appreciate, the use of such transverse support rods 17*a* and 17*b* tends to inhibit cupping and other undesirable deformation of the guitar body 10.

Alternatively, the support rods may extend generally longitudinally within the cavity 13. As those skilled in the art will appreciate, any desired number and any desired configuration and orientation of such supports may be utilized.

Each of the transverse support rods 17*a* and 17*b* preferably comprises a wood rod or dowel having a generally circular cross section, which is wrapped with a graphite epoxy composite material, so as to enhance the strength and/or acoustic characteristics thereof. Alternatively, support rods 17*a* and 17*b* may comprise graphite tubes filled with a suitable sound damping material, such as a polymer foam material, as discussed below. Generally, it is desirable to utilize transverse support rods 17*a* and 17*b* having a density which is similar to that of wood.

For example, each of the transverse support rods 17*a* and 17*b* may comprise a high density structural foam material having graphite epoxy composite material formed thereover, i.e., defining a outer layer or cover therefor. The graphite epoxy composite material provides the desired structural strength for such braces, while the high density structural foam inhibits undesirable vibration of the graphite epoxy composite material. Alternatively, the transverse support rods 17*a* and 17*b* may be formed of another material such as magnesium, aluminum, or solid plastic, preferably having graphite epoxy composite material formed thereover.

Preferably, the support rods 17*a* and 17*b* do not contact the soundboard 30. However, the support rods 17*a* and 17*b* and/or any braces which are utilized, may be configured so as to contact the soundboard 30 (so as to enhance the structural strength and/or so as to modify the acoustic properties thereof), if desired.

At least a portion of the cavity 13 may be formed in a stair-step or terrace fashion, so as to facilitate the formation of the back bevel 21. However, it is important to appreciate that the portion of the cavity 13 which corresponds to the back bevel 21 may alternatively be formed in a generally smooth or curved fashion, rather than in a stair-step or terrace fashion. Indeed, that portion of the cavity 13 which corresponds to the back bevel 21 may be formed in any desired fashion. The back bevel 21 and the front bevel 11 define contours which enhance comfort during playing of the guitar. The back bevel 21 and the front bevel 11 are important and well appreciated features of the contemporary Fender Stratocaster guitar.

With particular reference to FIG. 2, desired back bevel 21 enhances comfort during playing of the guitar, according to well known principles.

Referring now to FIG. 4, a soundboard 30 for the guitar body 10 comprises a generally planar material which is attached to the solid material of the body 10, so as to substantially cover the cavity 13. The soundboard 30 is preferably shaped so as to conform generally to the shape of the body of the guitar. However, the soundboard 30 may alternately have any other desired shape. Preferably, the soundboard is comprised of a graphite epoxy composite, which provides desired strength and acoustic properties. As discussed below, such graphite epoxy composite material has sufficient strength to permit the construction of a comparatively thin soundboard, thereby enhancing the desirable acoustic properties thereof. Further, the strength associated with such a graphic epoxy composite soundboard permits the construction of a soundboard without the requirement for bracing, so as to further enhance the acoustic properties thereof. However, the soundboard 30 may alternatively be comprised of fiberglass, a composite material, wood, plywood or any other desired material. Indeed, any combination of such materials may be utilized.

The soundboard 30 preferably comprises a single sheet of composite material having multiple layers of epoxy impregnated graphite fibers which have been preimpregnated, so as to comprise a range of between approximately 30% resin and approximately 70% fiber to approximately 50% resin and approximately 50% fiber. Preferably, the soundboard 30 comprises a single sheet of composite material having multiple layers of epoxy impregnated graphite fibers which have been impregnated, so as to comprise approximately 33% resin and 67% fiber. Preferably, the layers of the epoxy impregnated graphite fibers are arranged in laminates of unidirectional fibers. Preferably, between approximately three and approximately four times as many fibers are oriented in the longitudinal direction (along the length of the neck of the guitar) as are oriented in the transverse direction. Layers of the composite material are preferably equal and opposite in layered sequence.

Thus, the graphite unidirectional material is preferably stacked evenly from the center to each surface of the stack. That is, the top half of the stack is preferably a mirror image of the bottom half of the stack with respect to the direction of the graphite fibers in each layer of the stack. It is desirable to minimize unevenness in the stacked layers (such as unevenness due to misaligned angular orientation of the layers), since warpage of the resultant sheet is likely to result from such an inconsistency.

Preferably, the soundboard 30 is formed using 100% unidirectional pre-impregnated graphite fiber hot melt tape. One preferred example of a lay-up for the soundboard of the present invention comprises a total of eleven plies of unidirectional carbon fiber in an epoxy matrix, such that the soundboard is approximately 67% carbon fiber and approximately 33% epoxy resin, and wherein the pre-impregnation is approximately 138 grams/meter square in weight. The preferred lay-up is as follows: zero degree, zero degree, ninety degree, zero degree, zero degree, ninety degree, zero degree, zero degree, ninety degree, zero degree, and zero degree.

The exact number of layers of material which are used depends upon the thickness of the unidirectional layers. That is, the number of layers which are used depends upon the number of grams per square meter of material. Thus, if the unidirectional pre-impregnation is heavier and/or thicker, then fewer layers are typically necessary.

Either unidirectional fibers or woven graphite fabric may be disposed at top and/or bottom surfaces thereof. A decal or other image may optionally be applied to the upper surface (the visible surface) of the soundboard 30, as desired.

It has been found that the use of such a graphite epoxy composite soundboard 30 provides desirable sustain, as well as desirable tone and volume. That is, it has been found that the graphite epoxy soundboard 30 of the present invention can be made substantially thinner than a soundboard formed from spruce or other types of wood and that such a thinner graphite epoxy soundboard 30 provides superior sustain, as well as desired volume and tone.

The soundboard 30 is preferably formed of compression molded graphite. As used herein, compression molded graphite is defined to include multiple layers of pre-impregnated carbon fiber, having predetermined laminate directions, which have been subjected to uniform temperature and pressure. The uniform temperature and pressure can be provided in a variety of different ways. For example, heated platens can be used to press the layers of pre-impregnated carbon fiber at the desired pressure. In this instance, a steel mold is commonly utilized to prevent the layers from undesirably shifting in position. The use of a metal mold and heated platen provides a combination of uniform heat and pressure which results in desired uniformity of compaction during the curing process.

Alternatively, uniform pressure may be applied via the use of an airbag, wherein a vacuum is applied to the pre-impregnated carbon fiber layers while they are disposed within an air-tight bag. This results in the atmosphere pushing evenly upon the lay-up at approximately 15 psi. The airbag can be placed in an autoclave and additional pressure can then be applied. The airbag can optionally be placed into an autoclave to facilitate the application of additional pressure and/or heat.

Such construction of the soundboard is described in detail in U.S. Pat. No. 5,333,527, issued to Janes et al. on Aug. 2, 1994 and entitled Compression Molded Composite Guitar Soundboard, the entire contents of which are hereby expressly incorporated by reference.

As a further alternative, the soundboard 30 may be formed via reaction injection molding (RIM) of graphite or a similar material.

The soundboard 30 may also be formed via standard injection molding or via any other desired process.

The guitar soundboard 30 preferably has a thickness of between approximately 0.015 inch and approximately 0.125 inch. The soundboard 30 preferably has a thickness of approximately 0.060 inch when the guitar is intended to have steel strings. Optionally, the soundboard has a thickness of approximately 0.040 inch when the guitar is intended to have nylon strings. However, as those skilled in the art will appreciate, various other thicknesses of the soundboard 30 are likewise suitable, particularly so as to accommodate the use of unusual string gages. The thickness of the soundboard can be matched to the strings, so as to provide optimal performance, e.g., desired volume and tone. Thus, the thickness of the soundboard 30 may be varied, so as to facilitate compatibility with strings having a desired gage and formed of a desired material.

The thickness of the soundboard will vary for other instruments and depends substantially upon the number of strings, their tension and thickness.

Generally, the soundboard 30 will be formed so as to only be as thick as necessary in order to provide the desired structural strength in light of the tension applied thereto by the strings. Generally, the thinner that the soundboard 30 is, the greater the volume of the sound produced by the solid body acoustic guitar of the present invention will be. The thickness of the soundboard 30 will depend substantially upon the material from which the soundboard is fabricated, as well as the number of braces and type of braces (that is, the dimensions of the braces and materials from which the braces are formed) used to support the soundboard. Again, the soundboard 30 of the present invention is preferably formed so as to not require the use of braces.

Generally, the soundboard 30 will have a substantially uniform thickness throughout. However, the soundboard 30 may optionally have a reduced thickness in portions thereof For example, the soundboard 30 may have a reduced thickness at the periphery thereof, so as to better facilitate vibration of the soundboard 30. Further, when no opening is formed in the soundboard, it may be desirable to provide a portion of reduced thickness in the soundboard 30. This portion of reduced thickness may, for example, be located generally centrally (where openings are typically formed in a soundboard).

The use of a soundboard 30 comprised of graphite epoxy composite material is advantageous in that such material does not substantially change shape or dimensions after being cured and set up. Thus, the use of a graphite epoxy composite substantially inhibits undesirable creep of the soundboard.

The soundboard 30 is preferably attached to the body 10 via either the use of fasteners, such as screws or bolts, or via adhesive bonding. However, the soundboard 30 may be attached to the body 10 in any other desired manner. Preferably, the body 10 comprises a recess 23 formed such that the soundboard 30 is disposed generally flush with the upper surface of the body 10, so as to define a generally co-planar top surface of the body 10. In this manner, the soundboard 30 can blend into the body 10 in such a manner as to give the appearance of generally unitary construction of the guitar body. Such a recess 23 may be formed by routing the opening which defines the cavity 13. Alternatively, the soundboard 30 may be attached to the body 10 such that the soundboard 30 sits above body 10.

Optionally, bracing may be attached to the soundboard 30, so as to enhance the structural strength of the soundboard 30 and/or so as to modify the acoustic properties thereof. The use of such optional bracing generally permits the use of a thinner soundboard 30. The bracing may comprise wood bracing, composite material bracing, graphite covered wood bracing, or any other desired material. The bracing may be formed of either the same material as the soundboard 30 or of a different material. The bracing may be either attached to the soundboard 30 or integrally formed with the soundboard 30.

Thus, bracing may be formed separately from the soundboard 30 and then attached to the soundboard 30, such as via the use of fasteners or adhesive bonding. Alternatively, bracing which was formed separately from the soundboard 30 may merely contact (rather than be attached to) the soundboard 30, so as to provide the desired structural strength therefor and/or so as to increase the stiffness (and consequently the resonant frequency) of the soundboard 30. Preferably, such contact of the bracing with the soundboard 30 is with a preload.

The bracing may be formed integrally with the soundboard 30. Bracing may be formed to the soundboard 30 during laying up of the composite layers of the soundboard and may thus comprise material which is disposed intermediate such layers.

Optionally, a thin piece of wood or other desired material may be bonded to the bottom surface of the soundboard 30 directly beneath the bridge, so as to define a bridge support plate 35 which enhances the structural strength of the soundboard 30 proximate the bridge. The bridge support plate 35 is preferably either generally rectangular or oval in shape and preferably has a thickness of between 0.060 inch and 0.25 inch. The thickness of the bridge support plate is preferably approximately 0.100 inch. The bridge support plate 35 facilities the drilling of string holes through the comparatively thin soundboard 30 by providing additional structural strength where the string holes are drilled. The bridge support plate 35 also helps mitigate splintering of the graphite, which may otherwise occur due to such drilling.

The bridge support plate 35 also adds thickness to the body at the bridge, so as to cause the string ball-ends (the small cylinders around which the string is wrapped to terminate the string) to be positioned more deeply within the body and thus prevent the string wraps (the ends of the strings having an additional layer of wire wrapped thereabout) from rising too high through the holes such that the string wraps undesirably rest upon the saddle. The additional thickness of the body provided by the bridge support plate 35 tends to assure that the string wraps do not extend excessively from the body.

Additionally, the bridge support plate 35 prevents undesirable contact of the string ball-ends with the soundboard 30. As those skilled in the art will appreciate, the graphite epoxy composite soundboard 30 is comparatively brittle. Over time, the string ball-ends would tend to dig into, abrade, or otherwise damage the soundboard 30, if placed into direct contact into therewith. Thus, it is preferable that the string ball-ends contact the wooden bridge support plate 35, rather than the graphite epoxy composite soundboard 30.

Preferably, the bridge support plate 35 is comprised of maple or another comparatively hard wood. Alternatively, the bridge support plate 35 may be formed of any other suitable material.

Thus, according to the preferred embodiment of the present invention, six small holes are optionally drilled through the soundboard 30 and the bridge support plate 35, such that the six strings of the guitar can extend therethrough, so as to place the string ball-ends within the body of the guitar. The strings are then attached to the guitar and held in place via the use of pegs, according to well-known principles.

Optionally, the soundboard 30 may be formed so as to define a loaded configuration thereof. As those skilled in the art will appreciate, a loaded configuration is defined when a soundboard is slightly raised behind (away from the neck) the bridge and is slightly indented in front (toward the neck) of the bridge. In such a loaded configuration, there are no braces for the soundboard 30 directly under the bridge. However, a bridge plate 35 may optionally be provided under the bridge for the reasons discussed above. Such a loaded configuration provides a soundboard which is under greater string tension and which therefore vibrates readily in response to very slight vibrations of a string.

Figure 6:
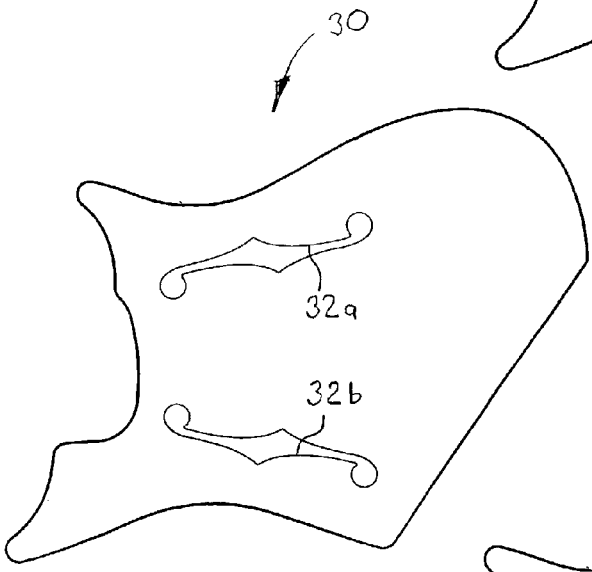
FIG. 6 is a front view of an alternative soundboard for the guitar body of FIGS. 1–3, wherein the soundboard has a pair of f-holes formed therein.
Figure 7:
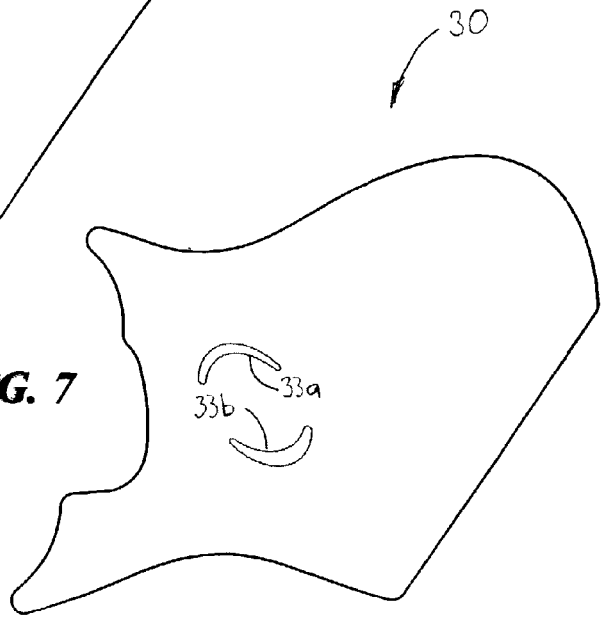
FIG. 7 is a front view of an alternative soundboard for the guitar body of FIGS. 1–3, wherein the soundboard has a pair of generally crescent shaped openings formed therein.

Referring now to FIGS. 5–7, the soundboard 30 optionally comprises one or more openings formed therein, so as to provide desired acoustic and/or aesthetic qualities. With particular reference to FIG. 5, such an opening may comprise a generally circular opening 31. With particular reference to FIG. 6, such openings may comprise one or more, preferably two, f-holes 32*a* and 32*b*. With particular reference to FIG. 7, such openings may comprise openings 33*a* and 33*b* which are configured in a double crescent fashion.

It is worthwhile to appreciate that the use of a graphite epoxy composite soundboard 30 provides substantial advantages with respect to a wood soundboard, such as a soundboard comprised of spruce. A spruce soundboard would have to be substantially thicker than a graphite epoxy composite soundboard and/or would have to be braced, thereby substantially reducing the volume of the cavity 13. Both the use of a thicker soundboard and the use of braces reduce the volume of the cavity 13 by providing material which occupies some of the volume of the cavity 13. Such a reduction in the volume of the cavity 13 inherently reduces the volume of the sound produced by the guitar. Thus, the use of graphite epoxy composite material for the soundboard 30 contributes substantially to the volume of the guitar. It has been found that graphite epoxy composite material has acoustic characteristics substantially similar to those of spruce, but is substantially stronger than spruce, thereby facilitating the construction of a comparatively thinner soundboard and also facilitating the construction of a soundboard which does not require bracing, so as to tend to maximize the volume of the cavity 13.

Figure 8:
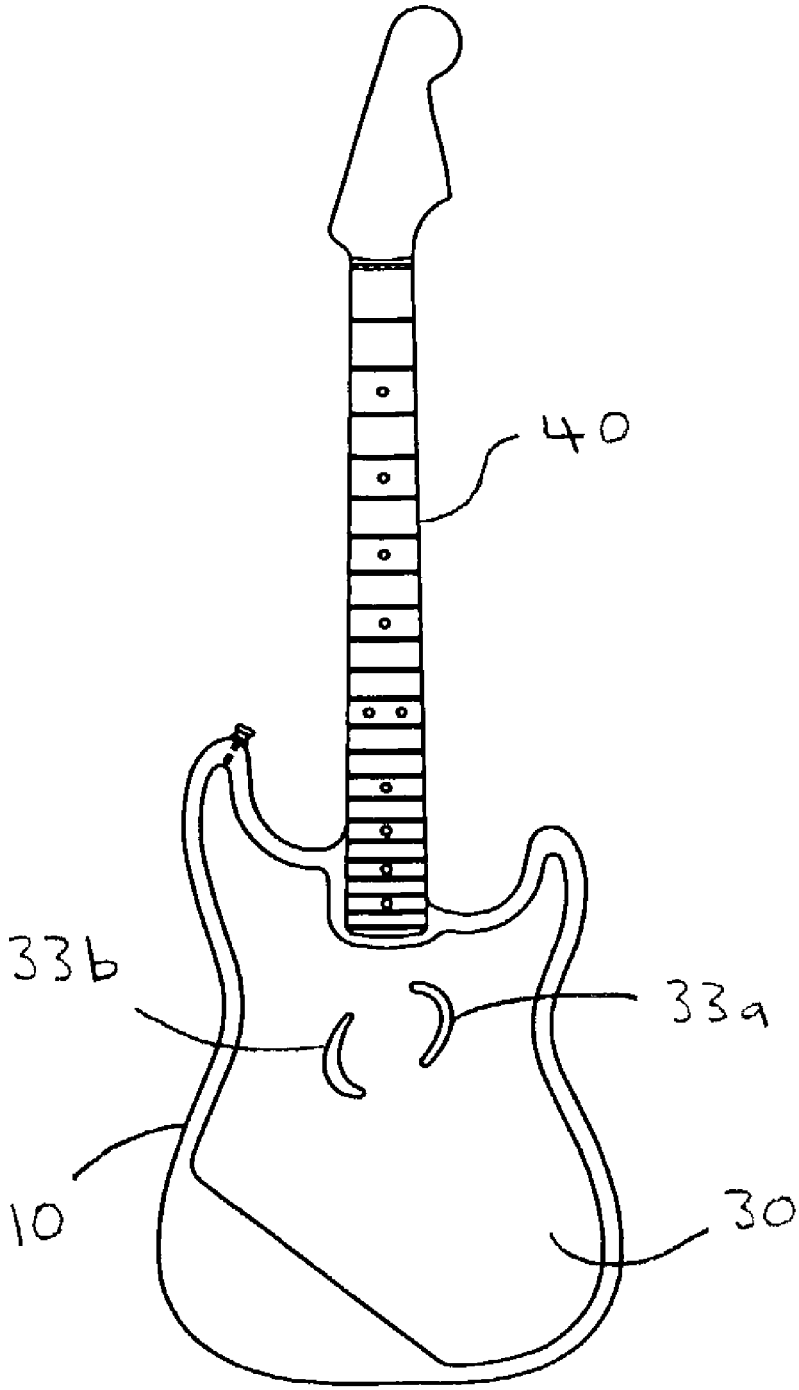
FIG. 8 is a front view of a solid body acoustic guitar having a pair of generally crescent shaped openings formed in the soundboard thereof, according to the present invention.

Referring now to FIG. 8, the body 10 may be attached to a neck 40, so as to provide a solid body style acoustic guitar which is generally the size and shape of a solid body electric guitar, which is substantially lighter than a solid body electric guitar, and which has adequate volume and proper tone to generally function as an non-electrically amplified acoustic guitar. The volume is at least adequate for practicing without the need for electronic amplification. The solid body style acoustic guitar of the present invention provides volume which is generally adequate for performing in intimate settings, such as a typical living room. As mentioned above, the present invention may alternatively comprise any desired combination of electronic pickups, magnetic transducers, ceramic transducers, piezoelectric transducers, volume controls, tone controls, and pre-amplifiers, so as to define a solid body style guitar which is suitable for both acoustic and electronically amplified use.

Thus, according to the present invention, an acoustic guitar is provided which has at least some of the advantages of a solid body electric guitar. These advantages include compact size, light weight, and comfort in use. Adequate sound for use in acoustic playing is provided by a cavity formed in the solid body and a soundboard which substantially covers the cavity. Desired tone and volume are provided by forming the soundboard from epoxy impregnated graphite fibers, as discussed above.

The graphite epoxy composite soundboard 30 of the present invention provides further advantages with respect to a contemporary wood soundboard. For example, the graphite epoxy composite soundboard 30 of the present invention is much less likely to crack, creep, or become otherwise undesirably changed, such as due to such factors as temperature, humidity, shock, vibration, or mishandling. Therefore, the graphite epoxy composite soundboard 30 of the present invention facilitates the production of a substantially more durable guitar.

The bridge (not shown) of the guitar is preferably attached to the soundboard 30 via adhesive bonding, preferably via the use of epoxy. Alternatively, any other desired means for attaching the bridge to the soundboard 30 may be used. For example, the bridge may alternatively be bolted or screwed to the soundboard 30. Further, any desired combination of means for attaching bridge to the soundboard 30 may be used. For example, the bridge may be both adhesively bonded and bolted to the soundboard 30.

The front and/or the back (including the soundboard) of the guitar may optionally be arched, if desired.

Thus, according to the present invention, a solid body acoustic guitar or a solid body electric guitar adequate for acoustic playing or a similar musical instrument is provided wherein the body preferably comprises contours or bevels which enhance comfort during playing and wherein the use of a graphite epoxy composite soundboard facilities acoustic playing. The contours or bevels preferably provide a guitar having a body configured substantially like the solid body of a Fender Stratocaster guitar.

The solid body style acoustic guitar of the present invention has been found to have desirable tone and very little feedback when pickups are utilized. The tone of the solid body style acoustic guitar of the present invention is very similar to that of a contemporary acoustic guitar. Therefore, the solid body style acoustic guitar of the present invention provides a generally historically desirable sound.

Where adhesive bonding, such as via the use of epoxy, is disclosed herein, DP100 epoxy provided by the 3M Corporation of Saint Paul, Minn. may generally be used.

It is understood that the exemplary solid body acoustic guitar described herein and shown in the drawings represents only a presently preferred embodiment of the invention. Indeed, various modifications and additions may be made to such embodiment without departing from the spirit and scope of the invention. For example, the present invention does not have to be fashioned in the style of a Fender Stratocaster guitar or any other solid body electric guitar. Rather, the solid body acoustic guitar of the present invention may be fashioned much in any desired manner.

For example, the solid body acoustic guitar of the present may, if desired, may be fashioned in the manner of a contemporary acoustic guitar. That is, the solid body acoustic guitar of the present invention may have greater thickness than that of a solid body electric guitar and may be styled in the fashion of a contemporary acoustic guitar, so as to generally mimic the appearance of a contemporary acoustic guitar, if desired.

The soundboard does not have to be shaped and styled in any particular manner (such as having a shape which generally conforms to the shape of the guitar body, as shown in FIG. 8). Rather, the soundboard may be shaped and styled in any desired manner.

Further, a plurality of cavities and/or soundboards, in any desired combination, may be utilized, instead of merely having single cavity and a single soundboard. Thus, for example, the body 10 may alternatively comprise two cavities and two soundboards or may alternatively comprise two cavities having a single soundboard covering both cavities.

According to the present invention, a wood body cooperates with a graphite epoxy composite soundboard to provide a guitar which approximates a historically desirable sound, such as that of an all wood guitar body and soundboard.

Those skilled in the art will appreciate that the present invention is not limited to guitars and may therefore find applications with various different stringed musical instruments. For example, the present invention may find use in the construction of mandolins, violins, banjos, basses, ukuleles, Dobros and other stringed musical instruments.

Thus, these and other modifications and additions may be obvious to those skilled in the art and may be implemented to adapt the present invention for use in a variety of different applications.

What is claimed is:

1. An acoustic stringed musical instrument, comprising:

a body of solid material having a cavity formed therein;

a soundboard formed of planar material covering the cavity of the body of solid material to form an acoustic amplifying chamber, the soundboard being made from multiple layers of epoxy impregnated graphite material which is preimpregnated to contain 30–50% resin and 50–70% fiber.

2. The acoustic stringed musical instrument of claim 1, wherein the body of solid material is made of wood.

3. The acoustic stringed musical instrument of claim 1, wherein the body of solid material is formed of a single piece of wood or a plurality of pieces of wood.

4. The acoustic stringed musical instrument of claim 1, wherein the instrument is selected from the group consisting of guitar, bass, mandolin, violin, banjo, ukulele, and Dobro.

5. The acoustic stringed musical instrument of claim 1, wherein the instrument is formed in the style of an electric guitar body.

6. The acoustic stringed musical instrument of claim 1, wherein the body of solid material is formed as a double cutaway guitar body.

7. The acoustic stringed musical instrument of claim 1, wherein the soundboard has a thickness of 0.015–0.125 inches.

8. The acoustic stringed musical instrument of claim 1, wherein the soundboard has a thickness of approximately 0.060 inch when the soundboard is to be used with steel strings and 0.040 inch when the soundboard is to be used with nylon strings.

9. The acoustic stringed musical instrument of claim 1, further including a graphite covered wood support rod disposed within the cavity for enhancing structural strength of the instrument.

10. The acoustic stringed musical instrument of claim 1, wherein the soundboard includes a sound hole formed off center of the soundboard.

11. An acoustic guitar, comprising:

a neck;

a body of solid material attached to the neck, the body having a cavity formed therein;

a soundboard formed of planar material covering the cavity of the body to form an acoustic amplifying chamber; and a plurality of support rods disposed within U-shaped grooves formed proximate to the soundboard, the support rods being oriented normal to a centerline of the neck and traversing the body for enhancing the structural strength of the acoustic guitar.

12. The acoustic guitar of claim 11, wherein a first support rod is positioned proximate to a center portion of the body and a second support rod is positioned between the first support rod and the neck.

13. The acoustic guitar of claim 11, wherein the soundboard includes first and second sound openings on opposite sides of the centerline of the neck.

14. The acoustic guitar of claim 11, wherein the support rods are circular.

15. The acoustic guitar of claim 11, wherein the support rods are formed as graphite tubes.

16. The acoustic guitar of claim 15, wherein the graphite tubes contain a material selected from the group consisting of wood and polymer.

17. The acoustic guitar of claim 11, wherein the body of solid material is made of wood.

18. The acoustic guitar of claim 11, wherein the soundboard is made with multiple layers of compression molded composite graphite.

19. The acoustic guitar of claim 11, wherein the soundboard is made from multiple layers of epoxy impregnated graphite material which is preimpregnated to contain 30–50% resin and 50–70% fiber.

20. A method of making an acoustic guitar body, comprising:

providing a neck;

providing a body of solid material having a cavity formed therein;

attaching the body of solid material to the neck;

disposing a soundboard formed of planar material over the cavity of the body to form an acoustic amplifying chamber; and disposing a plurality of support rods within the cavity of the body, the support rods being oriented normal to a centerline of the neck and traversing the body for enhancing the structural strength of the acoustic guitar.

21. The method of claim 20, further including disposing the support rods within U-shaped grooves formed proximite to the soundboard.

22. The method of claim 20, further including:

positioning a first support rod proximate to a center portion of the body; and positioning a second support rod between the first support rod and the neck.

23. The method of claim 20, further including forming first and second sound openings in the soundboard on opposite sides of the centerline of the neck.

24. The method of claim 20, wherein the support rods are circular.

25. The method of claim 20, further including forming the support rods as graphite tubes containing a material selected from the group consisting of wood and polymer.

26. The method of claim 20, further including forming the body of solid material from wood.

27. The method of claim 20, further including forming the soundboard with multiple layers of epoxy impregnated graphite fibers.

28. An acoustic guitar, comprising:

a neck;

a body of solid material attached to the neck, the body having a cavity formed therein;

a soundboard formed of planar material covering the cavity of the body to form an acoustic amplifying chamber; and a plurality of support rods disposed within the cavity of the body, the support rods being formed as graphite tubes for enhancing the structural strength of the acoustic guitar.

29. The acoustic guitar of claim 28, wherein the support rods are oriented normal to a centerline of the neck and traverse the body of the acoustic guitar.

30. The acoustic guitar of claim 28, wherein the support rods are disposed in U-shaped grooves formed proximate to the soundboard.

31. The acoustic guitar of claim 28, wherein a first support rod is positioned proximate to a center portion of the body and a second support rod is positioned between the first support rod and the neck.

32. The acoustic guitar of claim 28, wherein the soundboard includes first and second sound openings on opposite sides of the centerline of the neck.

33. The acoustic guitar of claim 28, wherein the support rods are circular.

34. The acoustic guitar of claim 28, wherein the graphite tubes contain a material selected from the group consisting of wood and polymer.

35. An acoustic guitar, comprising:

a neck;

a body of solid material attached to the neck, the body having a cavity formed therein;

a soundboard formed of planar material covering the cavity of the body to form an acoustic amplifying chamber; and a plurality of support rods disposed within the cavity of the body, the support rods being oriented normal to a centerline of the neck and traversing the body for enhancing the structural strength of the acoustic guitar.

36. The acoustic guitar of claim 35, wherein a first support rod is positioned proximate to a center portion of the body and a second support rod is positioned between the first support rod and the neck.

37. The acoustic guitar of claim 35, wherein the support rods are disposed in U-shaped grooves formed proximate to the soundboard.

38. The acoustic guitar of claim 35, wherein the support rods are formed as graphite tubes.

39. The acoustic guitar of claim 35, wherein the graphite tubes contain a material selected from the group consisting of wood and polymer.

40. The acoustic guitar of claim 35, wherein the soundboard includes first and second sound openings on opposite sides of the centerline of the neck.

41. The acoustic guitar of claim 35, wherein the support rods are circular.

* * * * *